US007987562B2

(12) United States Patent
Chaigne et al.

(10) Patent No.: US 7,987,562 B2
(45) Date of Patent: Aug. 2, 2011

(54) BUCKLE FOR FASTENING A SPORTS BOOT AND A SPORTS BOOT HAVING SUCH BUCKLE

(75) Inventors: Jérôme Chaigne, Gruffy (FR); Christophe Borlet, Seynod (FR)

(73) Assignee: Salomon S.A.S., Metz-Tessy (FR)

( * ) Notice: Subject to any disclaimer, the term of this patent is extended or adjusted under 35 U.S.C. 154(b) by 742 days.

(21) Appl. No.: 12/109,485

(22) Filed: Apr. 25, 2008

(65) Prior Publication Data

US 2008/0263901 A1 Oct. 30, 2008

(30) Foreign Application Priority Data

Apr. 27, 2007 (FR) ..... 07 03120

(51) Int. Cl.
*A43C 11/14* (2006.01)

(52) U.S. Cl. ..... 24/68 SK; 24/71 SK

(58) Field of Classification Search ..... 24/68 SK, 24/69 SK, 70 SK, 71 R–71 SD, 270, 273, 24/191; 36/50.5
See application file for complete search history.

(56) References Cited

U.S. PATENT DOCUMENTS 5,383,258 A * 1/1995 Nicoletti ..... 24/68 SK
2006/0207126 A1 9/2006 Pallatin

FOREIGN PATENT DOCUMENTS

| | | | |
|---|---|---|---|
| CA | 1 136 406 | A | 11/1982 |
| EP | 1 369 050 | A1 | 12/2003 |
| EP | 1 493 347 | A1 | 1/2005 |
| FR | 788 580 | A | 10/1935 |
| FR | 1 395 510 | A | 7/1965 |

* cited by examiner

*Primary Examiner* — James R Brittain
(74) *Attorney, Agent, or Firm* — Greenblum & Bernstein, P.L.C.

(57) ABSTRACT

The invention relates to a buckle for fastening a sports boot and to a sports boot including such buckle. The buckle includes a baseplate, a lever connected to the baseplate by a first transverse articulation about an articulation axis, the lever having a gripping portion, a connecting rod articulated to the lever by a second transverse articulation about a second articulation axis, a loop mounted at the other end of the connection rod. The lever has a lever body that has a guiding tube for each of the articulation axes. The body is formed by a sheet of material, and the sheet is folded along folding lines that are parallel to each of the articulation axes to form the tubes for guiding the articulation axles.

11 Claims, 3 Drawing Sheets

1
7
8
7b
15b
16b
5a
4
5b
2
2b
10
12
5
2a
15a
16a
13
7a 1
12
5
7
8
4
3
10
2
2a

BUCKLE FOR FASTENING A SPORTS BOOT AND A SPORTS BOOT HAVING SUCH BUCKLE

CROSS-REFERENCE TO RELATED APPLICATION

This application claims priority under 35 U.S.C. §119 of French Patent Application No. 07 03120, filed on Apr. 27, 2007, the disclosure of which is hereby incorporated by reference thereto in its entirety.

BACKGROUND OF THE INVENTION

1. Field of the Invention

The invention relates to relates to a buckle for fastening a sport boot, especially a ski boot. The invention also relates to a boot equipped with at least one such a fastening buckle.

2. Description of Background and Other Information

The shell of a ski boot is usually fastened by bringing two flaps closer together by means of buckles. Currently available buckles include those that comprise a loop and a lever that are mounted on one flap and cooperate with a tooth or a rack mounted on the other flap. The loop is connected to the lever by means of a pin or rod. The lever is further articulated with respect to a baseplate that is fixed to the first flap and has, at its free end, a gripping portion provided to be grasped by the user's hand or fingers.

When the boot is being fastened, the end of the loop engages with a tooth of the rack, and the loop is pulled by means of the lever. In the final fastening phase, the lever is pressed flat against the shell of the boot and retains the loop by means of a knuckle-joint effect, i.e., an over-center effect. The patent documents EP 1 493 347 and EP 1 369 050 describe such fastening buckles.

The lever of a fastening buckle is subject to substantial forces, in this case the fastening force exerted on its gripping portion by the user, the resisting force opposed to the fastening by the loop of the buckle, and the force between the gripping area of the lever and the baseplate.

Moreover, the connection forces between the lever and the loop, and between the lever and the baseplate are transmitted by transverse articulation pins. And the articulation between the lever and the baseplate must also allow the connection to pass therethrough in order to enable closure of the knuckle-joint. The connection is made in two parts, each of which is cantilevered. This mode of construction requires the lever to have sufficient material thickness to guide the articulation pins, or portions of such pins.

In addition to the mechanical constraints, the designer of a fastening buckle must take into account ergonomic constraints related to the manipulation of the lever, as well as the user's positional comfort during such manipulation. The gripping zone of the lever must have a comfortable tactile sensation, and the effort required to close the buckle must be relatively measured.

Finally, boot makers increasingly impose aesthetic constraints aimed at integrating the buckle(s) into the general architecture of the boot. These constraints are expressed in terms of shapes and selection of materials, especially for the gripping zone of the lever.

SUMMARY OF THE INVENTION

In view of this state of the art, there is a need for a fastening buckle that is improved in that it provides the designer with more possibilities in addressing these various issues and constraints.

The present invention, as disclosed herein, achieves the aforementioned need.

The buckle of the invention includes a baseplate, a lever connected to the baseplate by a first transverse articulation about a first articulation axis, the lever having a gripping portion opposite its articulation to the baseplate, a pin articulated to the lever by a second transverse articulation about a second articulation axis located between the first articulation and the gripping portion, and a loop mounted at the other end of the pin.

According to the invention, the lever has a lever body that has a guiding tube for each of the articulation pins. The body is formed by a sheet of material, which is folded along folding lines that are parallel to each of the articulation axes to form the tubes for guiding the articulation pins.

In particular, the lever body is formed from a metal sheet that is folded over itself. The tubes for the articulation pins are formed by rolling the metal sheet around the pins in question, and not by perforation as is the case of conventional levers.

According to a feature of the invention, the lever includes a gripping portion that is formed at, or attached to, the end of the lever body. In this way, the body and the gripping portion can be made from different materials; in particular, the material and the shape of the gripping portion are selected for the specific function of manipulating the gripping portion. The mechanical function of connecting to the shell and of articulating is indeed mainly ensured by the lever body.

A buckle made in this manner is solid, easy to manipulate, and thin over its entire length, unlike conventional buckles whose levers are made either of a metal sheet, or by molding or overmolding.

BRIEF DESCRIPTION OF DRAWINGS

The invention will be better understood from the description that follows, with reference to the attached drawings, in which.

DETAILED DESCRIPTION OF THE INVENTION

Figure 1:
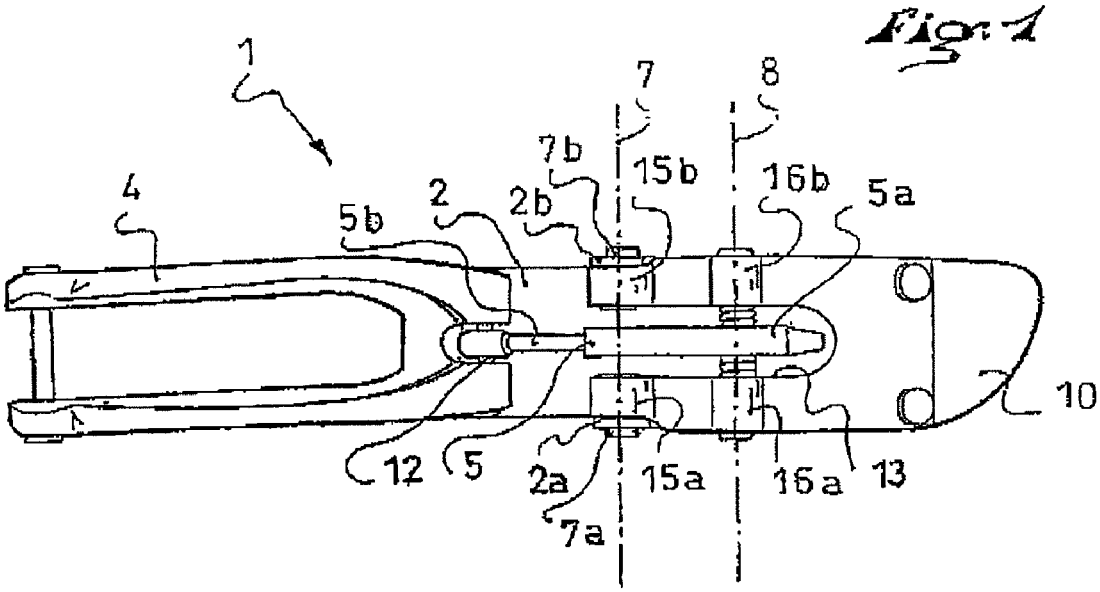
FIG. 1 is a top view of a buckle according to a first embodiment of the invention.
Figure 2:
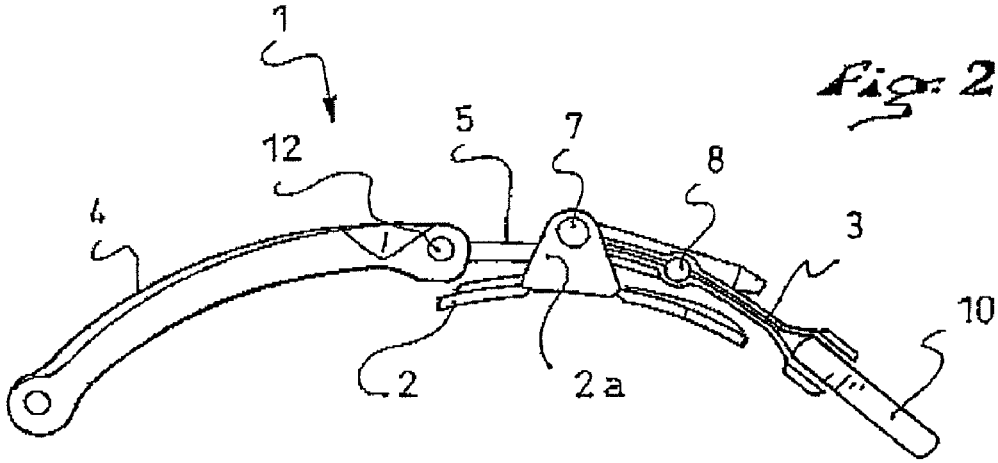
FIG. 2 is a side view of the buckle of FIG. 1.

FIGS. 1 and 2 show a buckle 1, which conventionally includes a support base 2, or baseplate, a manipulable lever 3, an attachment loop 4, and a connection rod 5.

Figure 4:
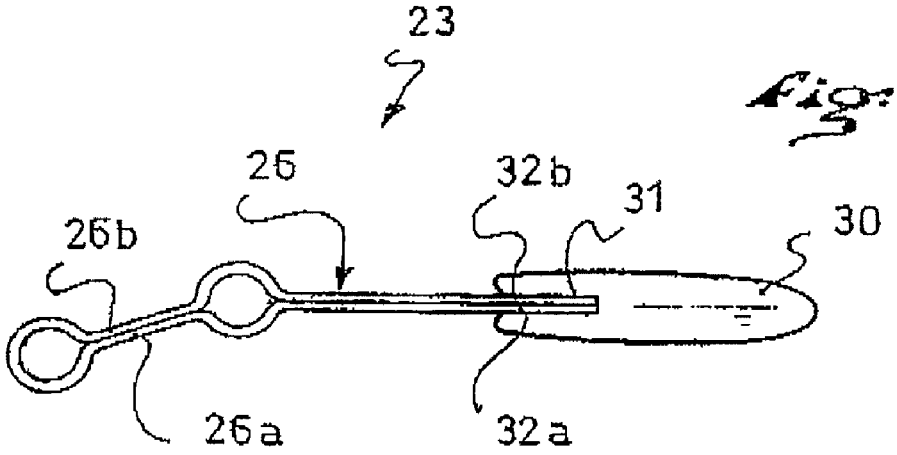
FIG. 4 relates to an alternative construction.

The baseplate is provided to be fixed to one of the flaps of the boot. Any appropriate connection for this purpose, such as screws or rivets, for example, is suitable. It is within the scope of the invention that the position of the baseplate on the flap can be adjustable. Examples of buckles mounted on a boot, non-limiting to the invention disclosed herein but disclosing exemplary positions on a boot, for example, are Illustrated in FIGS. 1 and 4 of US 2006/0207126, the disclosure of such document being incorporated herein by reference thereto in its entirety.

The lever 3 is articulated in relation to the baseplate about an articulation axis 7, and it has a second articulation about an axis 8 for the connection rod 5. The two axes 7 and 8 are parallel in the illustrated embodiment, although they could be other than parallel. Beyond the articulation axis 8, the lever has a gripping portion 10 that extends a lever body 6 (see FIG. 6), and which is described in greater detail below.

The connection rod 5 is connected by another end to the loop 4 provided to be engaged in one of the spaces between teeth of a rack, and to be retained by one of the teeth, that is fixed to the other flap of the boot, and which is not shown in the drawings. Instead of a rack, a mere single catching tooth can be provided on the other flap of the boot. The connection rod 5 is connected to the loop 4 about an articulation axis 12. Other means for connecting the lever with the loop are also suitable. In particular, the connection rod 5 could be extended by a loop made of wire, which provides the loop with a relative flexibility. In a perpendicular direction with respect to the surface defined by the loop.

The connection rod 5 can be made to be adjustable lengthwise. For example, the rod 5 can be made in two portions 5*a* and 5*b* which are screwed one into the other so as to produce a useful length of the rod that is variable as a function of the number of threading pitches in mutual engagement.

The lever body 6 has, in its median zone, a cutout or recess 13 that extends over a portion of its length, from the zone of the articulation axis 8 up to its end located on the side of the axis 7. The dimensions of the recess 13 are greater than the dimensions of the connection rod 5 in order to enable the connection rod to engage in the recess 13 when the lever 3 is being maneuvered.

To enable the connection rod 5 to engage freely in the recess 13, the "pin" extending along the axis 7 is made in two portions 7*a*, 7*b* located on both sides of the housing, in the alignment of one another. Any appropriate means can be suitable for maintaining the two portions 7*a* and 7*b* in alignment. According to the illustrated embodiment, the portions 7*a* and 7*b* extend through the ears 2*a* and 2*b* of the baseplate 2, and they are guided mainly in a guiding tube of the lever body 6 formed by two portions 15*a* and 15*b* located on each side of the recess 13, in the alignment of one another.

The lever body 6 also has two aligned tube portions 16*a*, 16*b* located on each side of the recess 13, for guiding the articulation pin at the axis 8 of the connection rod 5. These portions are located between the tube portions 15*a*, 15*b* and the gripping portion 10.

The tube portions 16*a* and 16*b* are substantially parallel to the portions 15*a* and 15*b*.

According to a characteristic of the invention, the lever body 6 is made from a sheet of material that is cut and folded over itself to form two panels 6*a*, 6*b*, which are superimposed and shaped so as to form the tubes by rolling the sheet around the articulation pin. For example, the sheet is made of steel or aluminum alloy. However, this is not limiting, and one could use a sheet made of a composite material, the resin matrix of which could be cured after shaping. If the lever body is metallic, it can receive any appropriate surface treatment in order to improve its appearance and to protect it from oxidation.

Figure 3:
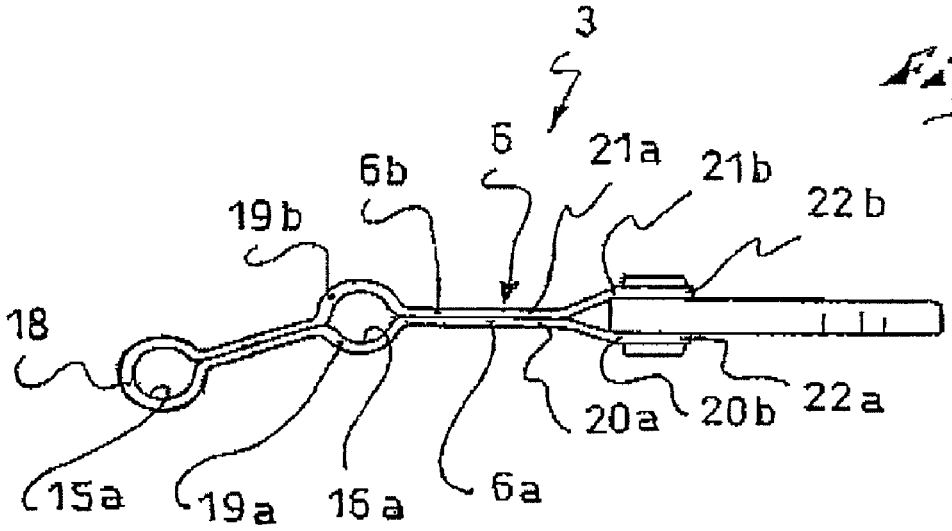
FIG. 3 more particularly shows the lever of the device of FIGS. 1 and 2.

FIG. 3 is a side view of the lever 3 of the buckle 1. The lever body is made from a steel sheet. It is formed of a sheet folded along two panels 6*a* and 6*b* that are superimposed and assembled to one another. The folding zone has a rounded shape 18 so as to form the tubes 15*a*, 15*b* for the pins at the axis 7. Also, each panel is shaped along a complementary rounded portion 19*a*, 19*b*, respectively, so as to form the guiding tubes for the pins at axis 8.

The rounded portion 18 and the rounded portions 19*a*, 19*b* are made by folding the sheet along lines that are parallel to the direction of the axes 7 and 8. The folding lines here are symmetrically distributed between the two panels of the lever body. Thus, when the buckle is assembled, each of the articulation axes is only surrounded by a material thickness of the sheet. Therefore, the lever body is particularly thin. It is therefore possible to bring the axis 7 closer to the baseplate, and therefore to construct a buckle that is more compact than currently available buckles.

The panels can be shaped using a die stamping technique, for example. Other implementation methods can also suitable.

The panels are assembled to one another by any appropriate means, for example, by means of rivets or by means of spot welding.

Making the lever body in two superimposed panels provides it with a sandwich-type structure which enables the lever to resist bending, and therefore to resist the forces to which it is subject when being manipulated.

One can provide to reinforce the bending strength of the lever using any appropriate means, in particular reinforcing ribs obtained by locally deforming one or both panels, as is commonly done in steel-plate construction.

The lever is manipulated by a user by means of a gripping portion 10 located opposite the articulation axis 7. According to the illustrated embodiment shown, the portion 10 is formed by a piece of a synthetic material. Such material, for example, can be a plastic material or a fiber-reinforced resin. Other materials are also suitable.

The surface of the gripping portion 10 is sufficient to enable the lever to be manipulated with the palm of the hand or with the fingers, as is usually done. The gripping portion of the lever can have a three-dimensional shape, i.e., it can have a concave shape, and/or it can be provided with projections.

According to the illustrated embodiment, the two panels 6*a* and 6*b* are spaced apart at the end of the lever body by two successive folding lines 20*a*, 20*b*, 21*a*, 21*b*, respectively, and the edge of the gripping portion is engaged between the end lugs 22*a*, 22*b* thus formed. The assembly between the lever body and the gripping portion has a sandwich-type structure that renders the connection highly resistant to bending.

The gripping portion 10 and the lugs 22*a*, 22*b* are assembled by any appropriate means, such as rivets, for example. Other means are also suitable.

As a variation, FIG. 4 shows a lever 23 having a lever body 26 with two panels 26*a* and 26*b*. The end lugs 32*a* and 32*b* of the panels are pressed flat on one another, and the gripping portion 30, which has an open housing 31, is fitted on the edges in the manner of a cap. The portion 30 is assembled by any appropriate means, such as mechanical fastening, gluing, hot welding, or the like.

These methods of constructing the lever make it possible to select different materials for the lever body and the gripping portion and, therefore, to provide the manufacturer with a wide range of possibilities to work with the mechanical and aesthetic properties of the gripping portion, while having a very thin lever in the end.

Figure 5:
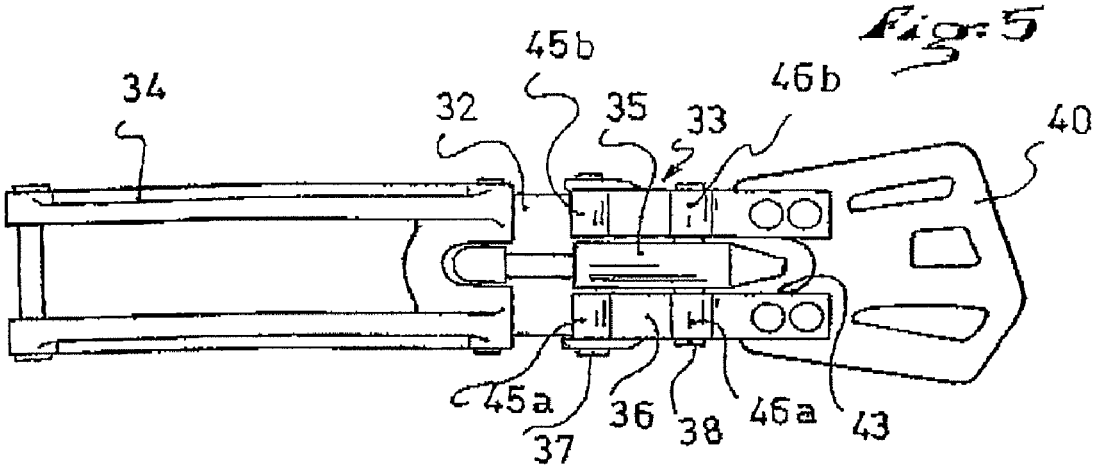
FIG. 5 shows a lever according to another embodiment of the invention.
Figure 6:
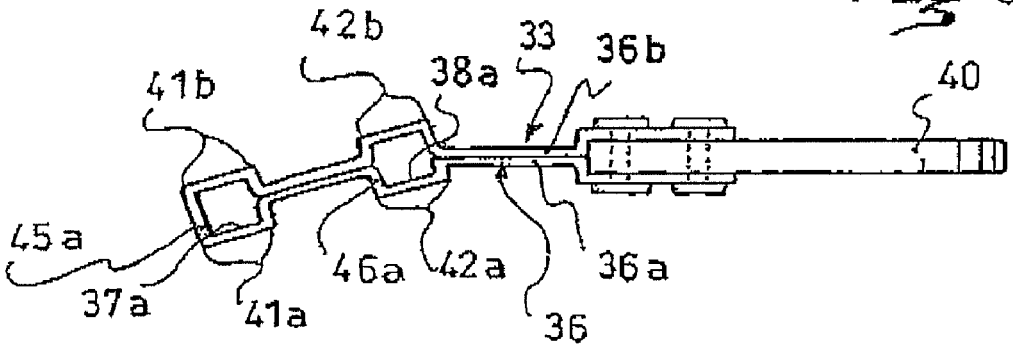
FIG. 6 is a side view of the lever of FIG. 5.

FIGS. 5 and 6 relate to an alternative construction of the buckle of the invention.

As described above, the buckle has a baseplate 32, a lever 33, a fastening loop 34, and a connection rod 35, with articulation axes 37 and 38.

The lever is constructed with a lever body 36 made by means of two panels 36*a*, 36*b*, and a gripping portion 40.

On the side that is shown in FIG. 5, the recess 43 extends up to the end of the lever body opposite the tubes 45*a*, 45*b* for the pins extending along axis 37.

Thus, as is particularly shown in FIG. 6, the tube portions 45*a*, 45*b*, 46*a*, 46*b* are made by folding the sheet of the lever body, not along rounded shapes but along the folding edges

41*a*, 41*b*, 42*a*, 42*b* which provide each tube with a polygonal inner cross section 37*a*, 38*a*. The folding lines are made parallel to the direction of the axes 37 and 38, so that the tubes are formed by rolling the sheet of material around the pins/rods at the axes 37, 38.

The gripping portion 40 here is perforated. It is made, for example, of a carbon fiber-base composite material and, as such, externally has a locally contrasted shiny appearance that is related to the presence of carbon fibers at the surface. Other materials are also suitable.

As described above, the end of the lever body opposite the tube portions 45*a*, 45*b* is shaped along lugs that are spaced apart, and between which the gripping portion is engaged. The gripping portion is fixed to the lever body by any appropriate means, such as rivets, for example.

Figure 7:
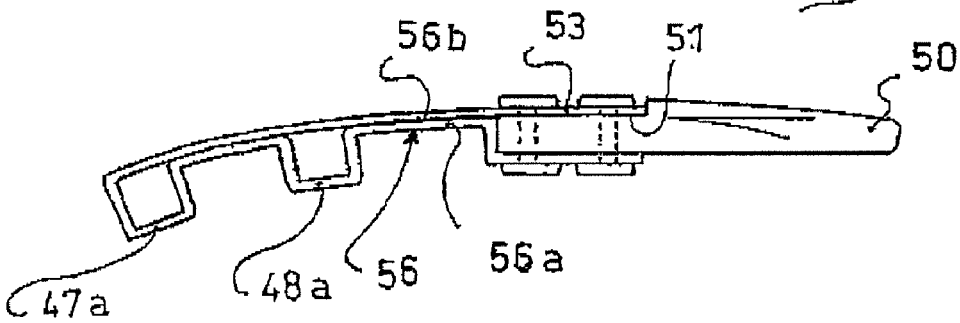
FIG. 7 shows an alternative construction of the lever.

FIG. 7 shows an alternative construction according to which the folding lines of the panels 56*a* and 56*b* are not symmetrically distributed. According to the illustrated embodiment, the panel 56*b* located on the outer side does not have folding lines; conversely, the panel 56*a* is folded to form the guiding tubes, only the tube portions 47*a* and 48*a* which are visible, and a recess for engaging the gripping portion 50. Thus, the folding lines are mainly borne by the panel 56*a*.

The portion 50 has a recess 51 on its outer surface. In which the lug 53 of the upper panel is housed. In this way, the outer surface of the lever does not have projecting elements. An inverse arrangement can also be adopted with all of the elements in relief on the outer surface of the lever.

The present description is only given by way of example, and other embodiments of the invention could be adopted without leaving the scope thereof.

In particular, the folding lines for making the two lugs between which the gripping portion engages are not necessarily parallel to the folding generating lines for the articulation axes. They can be oriented along a different direction. These lines are not necessarily rectilinear either.

A small return spring can be provided between the lever and the baseplate, and/or between the lever and the connecting rod so that, when the buckle is closed, the various elements are presented in a good position for an easier manipulation thereof.

Also, one could construct a lever by borrowing specific constructional techniques from the various embodiments that have been described, and by combining them.

The invention also encompasses a sports boot that has at least one buckle consistent with that which has been described hereinabove.

The invention claimed is:

1. A buckle for fastening a sports boot by bringing two flaps closer together, said buckle comprising:

a baseplate;

a lever connected to the baseplate by a first transverse articulation about an articulation axis, the lever having a gripping portion opposite the articulation to the baseplate;

a connection rod articulated at a first end to the lever by a second transverse articulation about a second articulation axis located between the first articulation and the gripping portion;

a buckle mounted to a second end of the connection rod;

the lever comprising a lever body having a guiding tube for housing a respective pin extending along each of the articulation axes;

the lever body being formed of a sheet of material, said sheet of material being folded along folding lines that are parallel to each of the articulation axes to form the guiding tubes for guiding said pins extending along the articulation axes.

2. A buckle according to claim 1, wherein:

the folded sheet forms transversely extending rounded loops.

3. A buckle according to claim 1, wherein:

the folded sheet forms transversely extending ridges.

4. A buckle according to claim 1, wherein:

the sheet is folded to form two superimposed panels assembled to one another by means of rivets.

5. A buckle according to claim 1, wherein:

the sheet is folded to form two superimposed panels assembled to one another by means of spot welding.

6. A buckle according to claim 1, wherein:

the sheet is folded to form two superimposed panels, said panels hating fold lines symmetrically distributed on the two panels.

7. A buckle according to claim 1, wherein:

the sheet is folded to form two superimposed panels, said panels having fold lines mainly borne by one of the two panels.

8. A buckle according to claim 1, wherein:

the sheet is folded to form two superimposed panels, the two panels having ends spaced apart to form lugs;

a gripping portion of the lever is engaged between the lugs of the two panels.

9. A buckle according to claim 8, wherein:

the lever body is made of metal; and the gripping portion of the lever is made of a synthetic material.

10. A buckle according to claim 8, wherein:

the gripping portion of the lever is perforated.

11. A sports boot comprising:

a pair of flaps;

a buckle for fastening the sports boot by bringing the two flaps closer together, said buckle comprising:

a baseplate;

a lever connected to the baseplate by a first transverse articulation about an articulation axis, the lever having a gripping portion opposite the articulation to the baseplate;

a connection rod articulated at a first end to the lever by a second transverse articulation about a second articulation axis located between the first articulation and the gripping portion;

a buckle mounted to a second end of the connection rod;

the lever comprising a lever body having a guiding tube for housing a respective pin extending along each of the articulation axes;

the lever body being formed of a sheet of material, said sheet of material being folded along folding lines that are parallel to each of the articulation axes to form the guiding tubes for guiding said pins extending along the articulation axes.

* * * * *